United States Patent [19]

Strassman

[11] 4,439,145

[45] Mar. 27, 1984

[54] ALUMINUM FURNACE AND PREHEATER THEREFOR

[75] Inventor: Richard J. Strassman, Milwaukee, Wis.

[73] Assignee: Badger Die Casting Corp., Milwaukee, Wis.

[21] Appl. No.: 323,362

[22] Filed: Nov. 20, 1981

Related U.S. Application Data

[63] Continuation of Ser. No. 312,782, Oct. 19, 1981, abandoned.

[51] Int. Cl.[3] ..... F27B 3/04; F27B 3/20; C21B 7/00

[52] U.S. Cl. ..... 432/164; 266/160; 266/175; 373/34; 373/80; 373/123; 432/93; 432/178

[58] Field of Search ..... 432/93, 164, 178, 179, 432/195; 266/160, 175, 162; 373/34, 80, 123

[56] References Cited

U.S. PATENT DOCUMENTS

| | | | |
|---|---|---|---|
| 588,267 | 8/1897 | Chalmot | 373/80 |
| 817,414 | 4/1906 | Brown | 266/175 |
| 995,979 | 6/1911 | McCloud | 266/160 |
| 1,297,641 | 3/1918 | Bookwalter | 373/123 |
| 1,610,376 | 12/1926 | Hitner | 373/34 |
| 3,839,016 | 10/1974 | Rawlings | 266/159 |
| 3,929,463 | 12/1975 | Svensson | 266/175 |
| 3,982,889 | 9/1976 | Olson | 432/128 |
| 4,010,935 | 3/1977 | Stephens | 266/901 |
| 4,027,862 | 6/1977 | Schaefer et al. | 266/160 |

FOREIGN PATENT DOCUMENTS

| | | | |
|---|---|---|---|
| 623086 | 7/1978 | U.S.S.R. | 432/13 |

*Primary Examiner*—John J. Camby

*Attorney, Agent, or Firm*—Isaksen, Lathrop, Esch, Hart & Clark

[57] ABSTRACT

A reverberatory furnace for melting aluminum or other metals which includes a preheater (12) which utilizes exhaust flue gasses from the furnace (10) to preheat the metal before it enters the furnace. A set of horizontal flue ducts (18, 20, 22) conduct the flue gasses to a preheater chamber (26) where they heat the metal. An air entrance port (50) is provided in the preheater chamber (26) to allow secondary combustion of the volatile flue gasses for additional efficiency.

6 Claims, 5 Drawing Figures

ALUMINUM FURNACE AND PREHEATER THEREFOR

This application is a continuation of co-pending application Ser. No. 312,782, filed Oct. 19, 1981, now abandoned.

FIELD OF THE INVENTION

The present invention relates to aluminum furnaces for melting aluminum to a molten state in general, and, in particular, the present invention relates to preheaters for heating aluminum, whether ingot or scrap, preparatory to complete melting in a reverberatory furnace.

DESCRIPTION OF THE PRIOR ART

In the prior art it has generally been the practice to put aluminum ingots or aluminum scrap or bulk material directly into an aluminum furnace for melting into molten aluminum. Most such aluminum melting furnaces include an exhaust stack which discharges vertically directly out of the furnace. Such exhaust stacks create a "chimney" effect as the combustion exhaust gasses resulting from the burning of fuel in the furnace, which are highly heated, tend to draw upward at a high rate creating a negative atmospheric pressure within the furnace chamber itself. The negative pressure created in the furnace chamber itself draws in cold air from the exterior of the furnace through cracks in the furnace apparatus and around the furnace doors so as to introduce new combustion air into the furnace. This new combustion air which is introduced into the furnace is, however, significantly colder than the air previously in the furnace and thus this inward rush of cold, fresh, uncombusted air cools the otherwise very hot gasses present in the furnace as a result of fuel combustion. This cooling of the burned gasses inside of the furnace decreases the efficiency of the furnace and increases the oxygen content of the gasses within the furnace, thereby increasing the proportion of molten aluminum in the furnace which oxidizes. Furthermore, in conventional metal furnace arrangements, the aluminum or other metal material normally enters the furnace at room temperature, or shortly above room temperature, and thus the metal must be heated from room temperature to its melting point in order to be reduced to a molten state.

SUMMARY OF THE INVENTION

The present invention is summarized in that an aluminum furnace includes: a furnace chamber in which aluminum is heated to its molten state; an flue gas duct attached to the furnace chamber to receive the combustion products therefrom, the flue gas duct being generally horizontal in direction and orientation; a furnace preheater chamber located adjacent to the furnace chamber, the furnace preheater chamber being connected so as to receive the gasses from the flue gas duct; at least one openable door opening into the preheater chamber so that material may be introduced therein and removed therefrom; and an flue stack exiting from the preheater chamber vertically such that it ultimately exhausts gasses therefrom.

It is an object of the present invention to provide an aluminum furnace which is capable of melting aluminum to a fully molten state more efficiently so as to use less energy than was heretofore possible in the art.

It is another object of the present invention to provide a preheater for an aluminum or other metal furnace which preheats the aluminum prior to the introduction of the metal into the furnace.

It is yet another object of the present invention to obtain maximum usefulness from the flue gasses in the combustion products from an aluminum furnace so that maximum efficiency is obtained in the use of combustion fuel.

Other objects, advantages, features of the present invention will become apparent from the following specification, when taken in conjunction with the accompanying drawings.

DESCRIPTION OF THE PREFERRED EMBODIMENT

Figure 1:
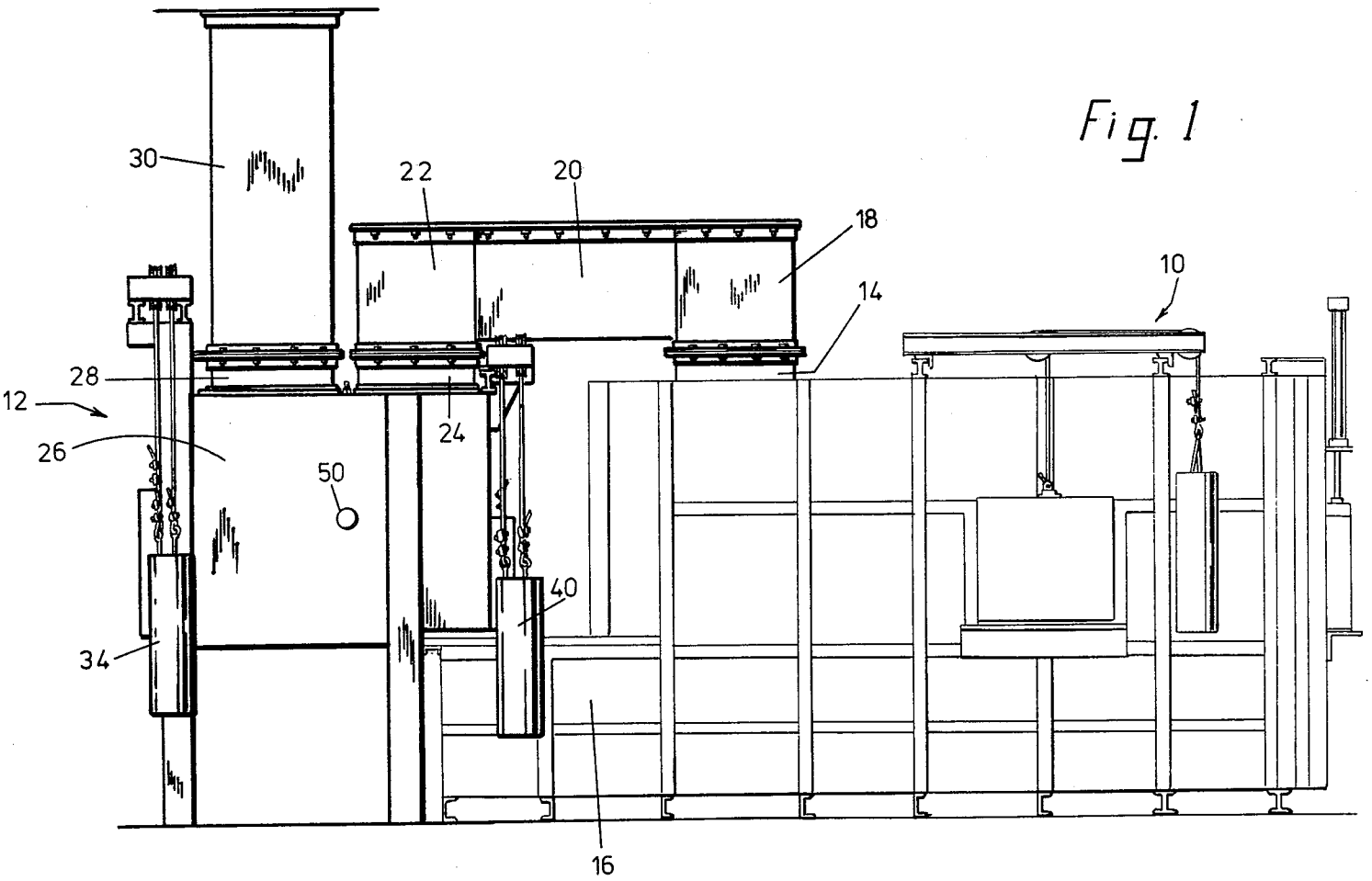
FIG. 1 is a side elevation view of an alumimium furnace constructed in accordance with the present invention.

Shown in FIG. 1, and generally indicated at 10, is an improved aluminum furnace generally constructed in accordance with the present invention. The aluminum furnace is generally constructed of previously known components with the addition thereto of a preheater unit, generally indicated at 12, added thereto. The components of the preheater unit 12 are illustrated in bold lines in the illustrations of FIGS. 1 and 2 in contrast to the other more conventional components of the furnace 10 which are illustrated with less bold lines.

The parts of the furnace 10, excepting those parts in the preheater 12, form a conventional reverberatory metal melting furnace. The furnace is designed to melt aluminum ingots or scrap which are placed therein into a thoroughly molten state. The heat in the furnace is provided by combustion of fossil fuel and the fresh air for use in the combustion of the fuel is drawn from the environment in which the furnace 10 is placed. The exhaust gasses from the combustion in the furnace 10 exit through a furnace exhaust flue 14 provided on the top of the furnace 10. Material is introduced into the furnace 10, to be melted, by being introduced into a charge well, which is not shown in greater detail, but is indicated at 16 in FIG. 1. Molten metal exits from the furnace 10 through a molten outlet port (not shown) in the opposite side of the furnace from that viewed in FIG. 1.

Describing now in detail the parts of the preheater unit 12, the preheater unit 12 includes a flue duct junction 18 which is connected to the exhaust flue 14 on the furnace 10. The flue duct junction 18 is connected at its other end to a horizontal flue duct 20 which connects in turn to a second flue duct junction 22. The flue duct junction 22 is connected at its other end to a flue inlet 24 provided on the top the preheater unit 12. The input flue 24 is mounted on the top of a preheater chamber 26. The preheater chamber 26 is a large, rectangular reverberatory chamber similar in construction to the chamber of the furnace 10. The flue duct junctions 18 and 22 with the horizontal flue duct 20 form a horizontal flue gas duct to provide a generally horizontal flue gas path connecting the furnace chamber of the furnace 10 to the preheater chamber 26.

Figure 3:
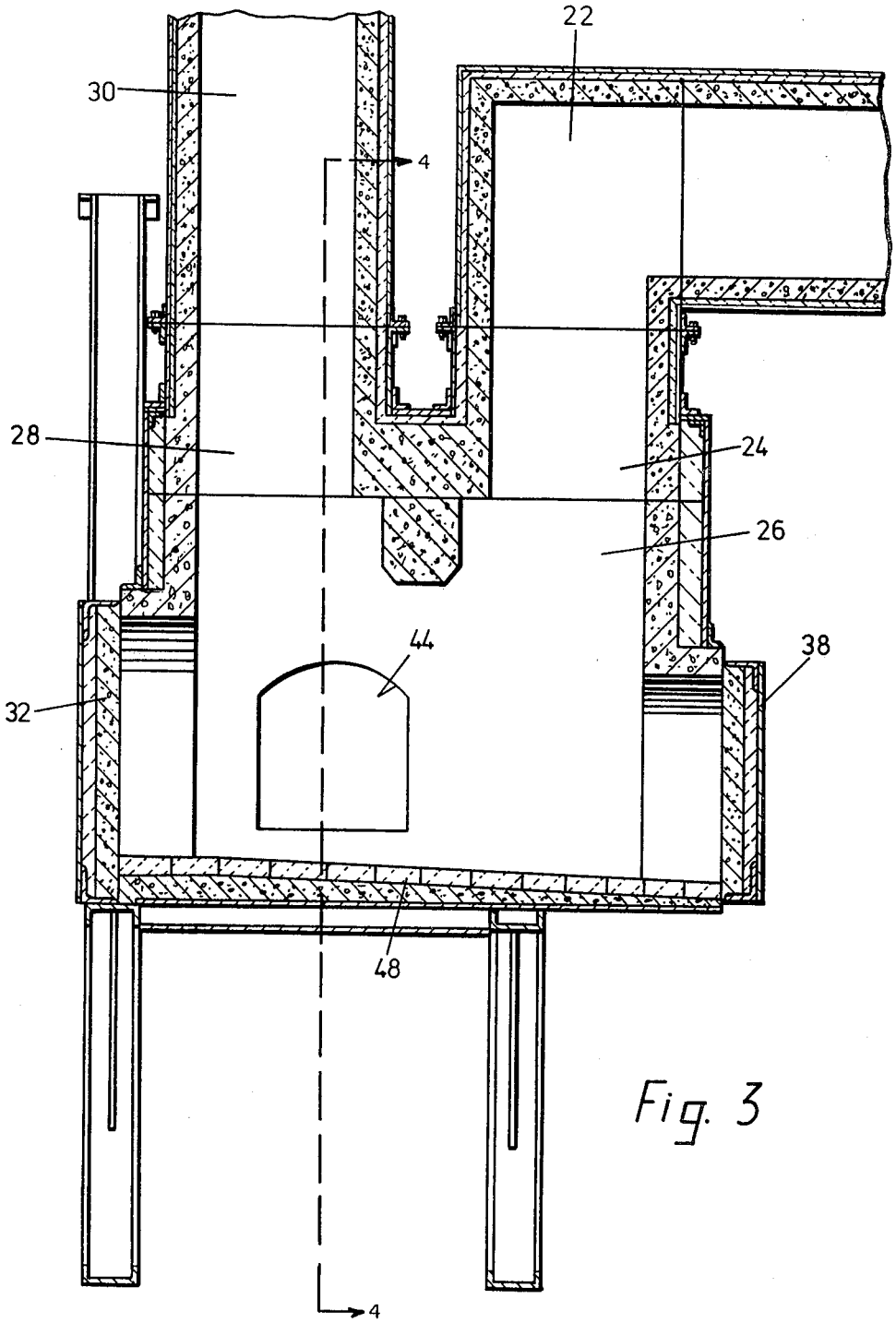
FIG. 3 is a cross-sectional view taken along the lines 3—3 of FIG. 2.
Figure 4:
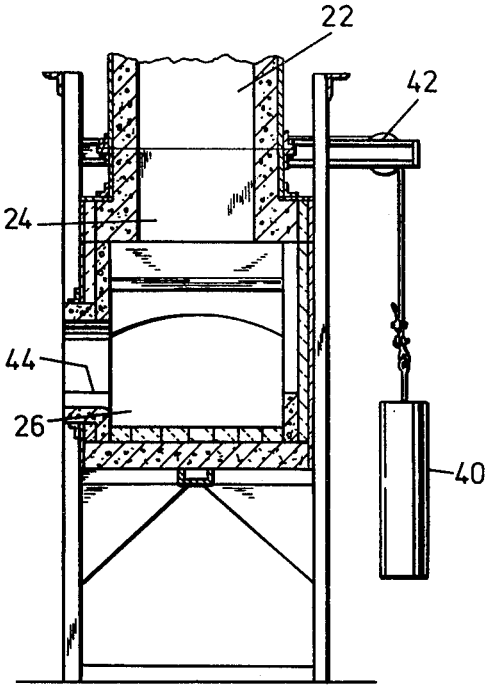
FIG. 4 is a cross-sectional view taken along the lines 4—4 of FIG. 3.
Figure 5:
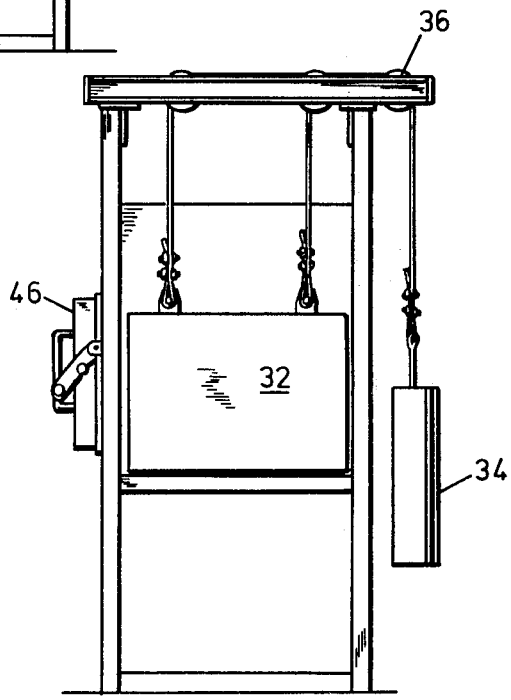
FIG. 5 is an end elevational view of the front of the preheater of the furnace of FIG. 1.

Shown in FIG. 3 is a cross-sectional view through the preheater chamber 26. The side walls of the preheater chamber 26 are formed of cast fire-resistant and heat-resistant material insulated on the exterior thereof so as to form a reverberatory chamber for preheating materials placed therein. On top of the preheater chamber 26 at the front thereof there is the flue inlet 24 attached to the flue duct junction 22. Toward the front of the preheater chamber 26 at the top thereof an exhaust flue opening 28 is formed connected to an exhaust stack 30. At the front end of the furnace preheater chamber 26 an entrance door 32, formed of materials similar to the materials on the interior of the remainder of the preheater chamber 26, is mounted. The entrance door 32 is mounted connected to an appropriate counterweight 34 suspended from a carriage 36, as can be viewed in FIG. 5, so that the door can be manually opened and closed. Similarly, an exit door 38 is formed at the rear of the preheater chamber 26 operated by a counterweight 40 suspended over a carriage 42. An access door opening 44 is formed on one side of the preheater chamber wall 26 and is closable by an access door 46 which is mounted on a hinge on the exterior of the preheater chamber 26 itself. The bottom of the preheater chamber 26 is formed by a preheater chamber floor 48 which is constructed of heat resistant material and which is formed in a canted or sloped fashion so as to slope downward from the front entrance door 32 of the preheater chamber 26 toward the exit door 38. The cant or slope in the floor 48 is sufficient so that molten material thereon will tend to flow downward toward the exit door 38. A secondary air entrance port 50 is formed in the side wall of the preheater chamber 26 opposite from the access door 46. The secondary air entrance port 44 is a small aperture through the side of the preheater chamber 26 intended to allow a restricted amount of air to pass therethrough.

Figure 2:
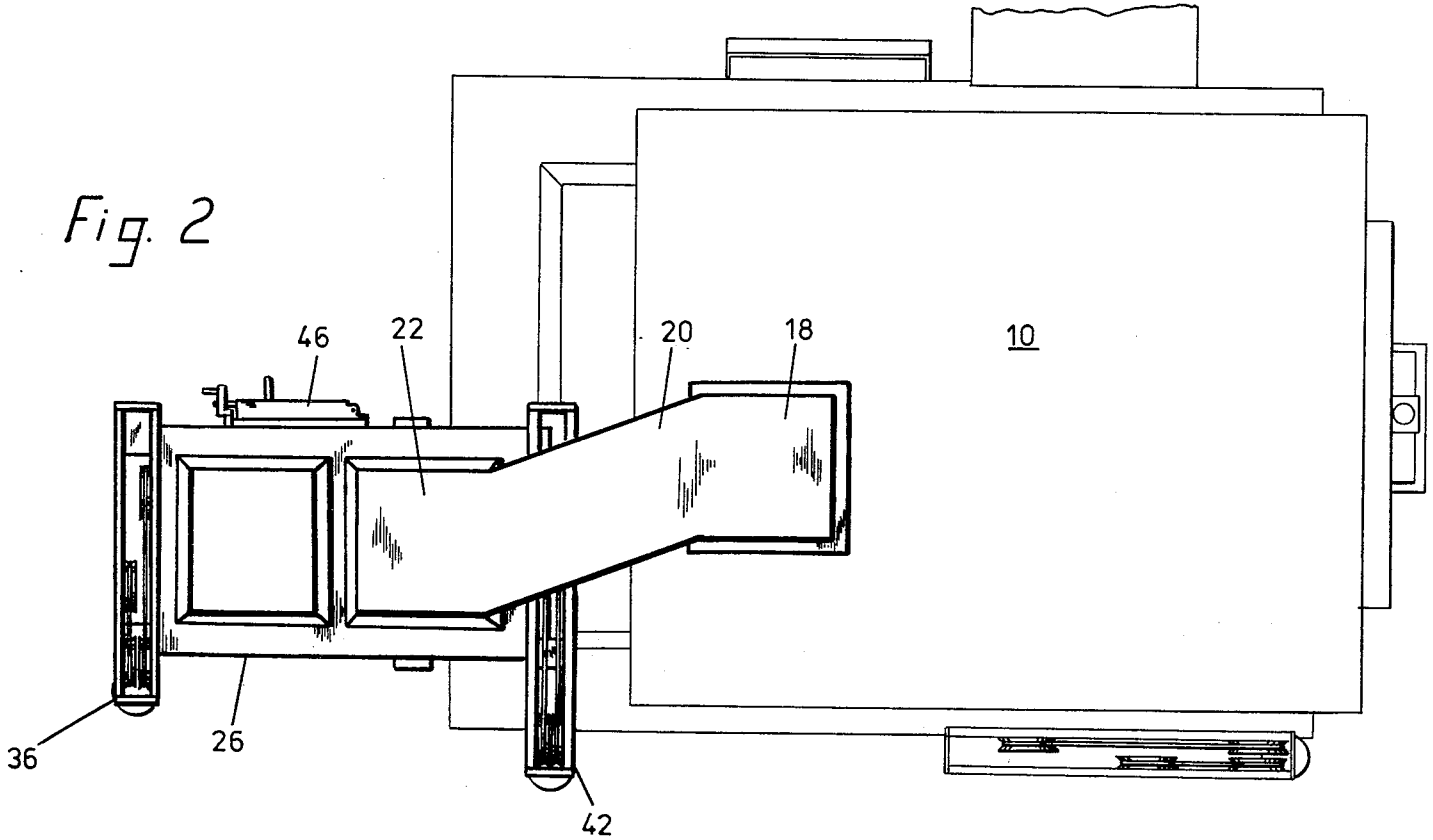
FIG. 2 is a top plan view of the furnace of FIG. 1.

In its operation, the reverberatory furnace 10 of FIGS. 1 and 2 operates to melt ingot or scrap aluminum into molten material which can be cast into various shapes as desired. The preheater chamber 12 is intended to utilize some of the waste heat from the reverberatory furnace 10 to preheat the aluminum, thereby gaining some use out of the exhaust furnace gasses from the furnace 10. The preheater 12 also begins the process of heating the aluminum entering into the furnace 10 so that it does not need to be heated all the way from room temperature when placed in the furnace. In this fashion, double efficiency in operation of the aluminum melting furnace is achieved.

In a conventional aluminum melting furnace, the stack or exhaust from the furnace acts to create a "chimney" effect because of the fact that the chimney conventionally extends directly vertically upward from the furnace. The hot flue gasses exhausted from the furnace travel directly up the chimney or exhaust stack in a rapid fashion since they are heated to very high temperatures, thereby drawing fresh, cold air past the furnace doors into the furnace because of the negative pressure created by this upward rush. The continual drawing-in of cold, fresh air cools the incandescent and burning combustion gasses inside of the furnace, thereby decreasing combustion thoroughness and efficiency by lowering the temperature inside of the furnace. The inrushing of this cool, fresh air also increases the oxygen content inside of the furnace, thereby increasing the oxidation of the molten aluminum in the furnace. The increase in oxygen content caused by this process is well beyond what is required to maintain the combustion rate of the furnace necessary to generate a heat level sufficient to melt the aluminum. In the furnace 10 in FIG. 1, the "chimney" effect is greatly reduced because there is not a direct vertical outflow of the combustion exhaust gasses from the furnace. Instead, and by contrast, the flue gasses exiting from the furnace 10 exit through the flue duct joints and elements 14, 18, 20, 22 and 24 into the preheater chamber 26. The path for the combustion gases from the furnace 10 is upwardly through the exhaust flue 14 to the exit flue junction 18 and thence generally horizontally through the flue duct 20 to the second flue duct junction 22 and then downwardly through the flue inlet 24 into the preheater chamber 26 toward the floor 48 thereof. The required path of travel of the gases, horizontally through the ducts 18, 20 and 22, downwardly through the flue inlet 24, and then further downwardly into the preheater chamber 26 before the gases are drawn upwardly into the exhaust stack 30, results in a draw imposed on the furnace chamber 10 reduced from that which would be imposed if the stack 30 were directly connected to the exhaust flue 14 so that the exhaust gases were drawn directly upward. Because the downward conveyance of the flue gases into the preheater chamber 26 reduces the effect of the draw from the exhaust stack 30 on the pressure in the furnace chamber 10, a great negative pressure inside of the furnace chamber is not created and undesired input of fresh, cool air into the furnace 10 is minimized. Eventually, the exhaust gasses travel from the preheater chamber 26 up out through the exhaust stack 30 after which they may be used otherwise within the facility in which the furnace 10 is installed for industrial heat requirements.

The preheater chamber 26 is operated by opening the entrance door 32 and introducing material to be eventually melted in the furnace 10 into the preheater chamber 26 by setting it on the preheater chamber floor 48 prior to the operation of the furnace 10. The entrance door 32 is then closed and the furnace 10 operated in a conventional manner. The exhaust flue gasses travelling through the preheater chamber 26 directly transfer some of their heat to the material placed within the preheater chamber 26. This heat transfer occurs as the flue gasses directly contact the metal in the preheater chamber 26 and also as the incandescence emitted by the hot gasses is reflected back off the reverberatory walls of the preheater chamber onto the metal. Furthermore, the air entrance port 50 allows the introduction of some small amount of fresh air into the preheater chamber 26. The size of the port 50 is selected so as to not introduce so much oxygen as to cause significant oxidation of the metal but, nevertheless, to allow the introduction of some air into the preheater chamber 26 to allow secondary combustion of the incandescent gasses which are passing through the chamber. It has been found, that with a diameter of one and a half inches for the entrance port 50, sufficient air is introduced into the preheater chamber 26 to cause continuous incandescent ignition of the volatile materials contained in the flue gasses passing through the preheater chamber 26, but yet there is not enough excess oxygen in the chamber to cause significant oxidation of the metal. The amount of air entering through the air entrance port 50 is also small enough not to cause any counterflow against the overall flue gas flow through the preheater chamber 26.

The metal stock material placed in the preheater chamber 26 is thus heated through at least two mechanisms. First there is direct heat transfer from the gasses passing through the preheater chamber 26 to the material placed within it. This direct transfer of the heat from the exhaust flue gasses passing through the preheater chamber 26 is aideds by heat reflected off of the furnace walls backward into the center of the preheat chamber 26 to heat the metal material placed thereon. Secondly, the introduction of a small amount of air through the air entrance port 50 causes secondary combustion of the volatile materials contained in the flue gas from the furnace 10, causing incandescent emission of gasses within the preheater chamber 26 introducing additional energy therein. A large portion of this energy is absorbed by the material placed within the preheat chamber 26 causing it to be preheated before final melting within the chamber of the main furnace 10.

After the operation of the furnace 10, when it is desired to transfer the material from the preheater chamber 26 into the furnace 10, the doors 32 and 38 can be opened and the material pushed from the preheater chamber 26 into the charging well 16 of the furnace 10 with a paddle. If the preheating of the preheater chamber 26 is sufficient to melt the material placed therein, the slanted floor 48 of the preheater chamber 26 ensures that when the door 38 is opened, the molten or semi-molten metal voluntarily flows out of the preheater chamber 26 into the charging well 16 contained in the furnace 10. Thus, whether or not the material is completely melted within the preheater chamber 26, it is relatively easy to transfer the material to the furnace 10 for final melting.

It has been found that using the preheater 12 in conjunction with the furnace 10, constructed in accordance with the present invention, that significant savings of energy input into the furnace can be achieved. It was found previously that an input of fuel capable of creating 4,000,000 BTUs per hour of input energy into the furnace was capable of just melting approximately 2,000 pounds of aluminum per hour. Through the use of the preheater 12 in conjunction with the furnace 10, it has been found that the same 4,000,000 BTUs of energy per hour is capable of thoroughly melting 2,000 pounds per hour of aluminum while at the same time heating an additional 2,000 pounds of ingot aluminum up to and beginning into a molten state. Therefore, the energy conservation achieved through the use of the preheater 12 is dramatic and has a great positive cost effect on the operation of the furnace 10 through the more efficient use of energy and fuel to achieve a more efficient melting process than was heretofore possible using the prior art.

It is to be understood that the present invention is not limited to the particular construction and arrangement of parts disclosed and illustrated herein, but discloses all such modified forms thereof as may come within the scope of the following claims.

I claim:

1. An improved aluminum furnace comprising:

a furnace chamber (10) in which aluminum is heated;

an aluminum preheater chamber (26) located adjacent to the furnace chamber (10);

at least one openable door (32,38) opening into the preheater chamber (26) so that material to be melted in the furnace may be introduced therein and removed therefrom;

an exhaust stack (30) exiting vertically from the preheater chamber (26); and a flue gas duct connecting the furnace chamber (10) to the preheater chamber (26) which includes a furnace exhaust flue (14) provided on the furnace chamber (10) to direct combustion exhaust gases upwardly therefrom, an exit flue junction (18) connected to the exhaust flue (14), a generally horizontal flue duct (20) connected to the exit flue junction (18), a second flue duct junction (22) connected to the horizontal flue duct (20) over a preheater chamber (26), the exit flue junction (18), horizontal flue duct (20) and second flue duct junction (23) conveying the exhaust gases in a generally horizontal direction, and a flue inlet (24) provided on the preheater chamber (26) and connected to the second flue duct junction (22) to convey exhaust gases downwardly into the preheater chamber (26) toward its floor (48) to heat metal therein wherefrom the exhaust gases are drawn upwardly into the exhaust stack (30), whereby the downward conveyance of flue gases into the preheater chamber (26) reduces the effect of the draw from the exhaust stack (30) on the pressure in the furnace chamber (10).

2. An improved aluminum furnace as claimed in claim 1 wherein there is an air entrance port (50) provided in the preheater chamber (26) so as to allow the introduction of some air into the preheater chamber (26) to cause secondary combustion of the gases present in the chamber so as to aid in the heating of any metal in the preheater chamber (26).

3. An improved aluminum furnace as claimed in claim 1 wherein there is a charge well attached to the furnace chamber (10) into which metal to be loaded into the furnace is placed and wherein there is a floor (48) on the bottom of the preheater chamber (26) which is sloped so that molten material thereon flows into the charge well of the furnace chamber (10).

4. A preheater adapted for attachment to an aluminum furnace having a furnace chamber (10), the preheater comprising:

an aluminum preheater chamber (26) located adjacent to the furnace chamber (10);

at least one openable door (32,38) opening into the preheater chamber (26) so that material to be melted in the furnace may be introduced therein and removed therefrom;

an exhaust stack (30) exiting vertically from the preheater chamber (26); and a flue gas duct adapted to connect the furnace chamber (10) to the preheater chamber (26) which includes a furnace exhaust flue (14) on the furnace chamber (10) to direct combustion gases upwardly therefrom, an exit flue junction (18) connected to the exhaust flue (14), a generally horizontal flue duct (20) connected to the exit flue junction (18), a second flue duct junction (22) connected to the horizontal flue duct (20) over the preheater chamber (26), the exit flue junction (18), horizontal flue duct (20) and second flue duct junction (22) conveying the exhaust gases in a generally horizontal direction, and a flue inlet (24) provided on the preheater chamber (26) and connected to the second flue duct junction (22) to convey exhaust gases downwardly into the preheater chamber (26)

toward its floor (48) to heat metal therein wherefrom the exhaust gases are drawn upwardly into the exhaust stack (30), whereby the downward conveyance of flue gases into the preheater chamber (26) reduces the effect of the draw from the exhaust stack (30) on the pressure in the furnace chamber (10).

5. An preheater for an aluminum furnace as claimed in claim 4 wherein there is an air entrance port (50) provided in the preheater chamber (26) so as to allow the introduction of some air into the preheater chamber (26) to cause secondary combustion of the gases present in the chamber so as to aid in the heating of any metal in the preheater chamber (26).

6. An preheater for an aluminum furnace as claimed in claim 4 wherein there is a charge well attached to the furnace chamber (10) into which metal to be loaded into the furnace is placed and wherein there is a floor (48) on the bottom of the preheater chamber (26) which is sloped so that molten material thereon flows into the charge well of the furnace chamber (10).

* * * * *